US008597059B2

(12) United States Patent
Bucheru et al.

(10) Patent No.: US 8,597,059 B2
(45) Date of Patent: Dec. 3, 2013

(54) PLUG MOVABLE TO A PLURALITY OF POSITIONS DEPENDING UPON CHARACTERISTICS OF A LOAD DEVICE

(75) Inventors: Bogdan Tudor Bucheru, Tucson, AZ (US); Pairor Thongkhumrol, Samutprakarn (TH); Jui Ching Huang, Samutprakarn (TH); Constanin Popescu, Bucharest (RO); Enrique H. Velasco, Jr., Tucson, AZ (US)

(73) Assignee: DET International Holding Limited, Georgetown (KY)

( * ) Notice: Subject to any disclaimer, the term of this patent is extended or adjusted under 35 U.S.C. 154(b) by 0 days.

(21) Appl. No.: 13/199,478

(22) Filed: Aug. 31, 2011

(65) Prior Publication Data

US 2012/0276785 A1 Nov. 1, 2012

Related U.S. Application Data

(60) Provisional application No. 61/402,490, filed on Aug. 31, 2010.

(51) Int. Cl.
*H01R 25/00* (2006.01)

(52) U.S. Cl.
USPC ..... 439/650

(58) Field of Classification Search
USPC ..... 439/650, 502, 246, 247, 669
See application file for complete search history.

(56) References Cited

U.S. PATENT DOCUMENTS

| | | | | |
|---|---|---|---|---|
| 5,668,698 | A * | 9/1997 | Jozwiak et al. | 361/752 |
| 6,805,579 | B2 * | 10/2004 | Marchand et al. | 439/502 |
| 6,811,444 | B2 * | 11/2004 | Geyer | 439/650 |
| 7,002,265 | B2 * | 2/2006 | Potega | 307/149 |
| 7,554,218 | B2 * | 6/2009 | DuBose et al. | 307/10.1 |
| 7,841,878 | B2 * | 11/2010 | Johnson et al. | 439/215 |
| 2001/0023037 | A1 | 9/2001 | Kieninger et al. | |
| 2003/0094302 | A1 * | 5/2003 | Magyar et al. | 174/68.3 |
| 2004/0033710 | A1 | 2/2004 | Kussel et al. | |
| 2005/0219882 | A1 | 10/2005 | Wu | |
| 2008/0151461 | A1 | 6/2008 | Kauffman | |
| 2009/0271556 | A1 | 10/2009 | Rutherford, III et al. | |

* cited by examiner

*Primary Examiner* — Chandrika Prasad

(57) ABSTRACT

A new and useful cable plug is provided, that is configured for a socket-plug system connecting a PSU to a load device over a 2 wire cable. The cable plug is selectively moveable to one of a plurality of positions for selecting a predetermined output voltage (or other operational characteristic) for the load device In addition, a new and useful socket is provided, that is configured to mate with the cable plug, to provide the selected output voltage (or other operational characteristic) for the load device.

5 Claims, 15 Drawing Sheets

PLUG MOVABLE TO A PLURALITY OF POSITIONS DEPENDING UPON CHARACTERISTICS OF A LOAD DEVICE

RELATED APPLICATION/CLAIM OF PRIORITY

This application is related to and claims priority from provisional application Ser. No. 61/402,490, filed Aug. 31, 2010, which provisional application is incorporated by reference herein.

INTRODUCTION

While Power Supply Units (PSU) are becoming more flexible and more intelligent, the mobile devices that are powered up by them are diversifying a lot, having different characteristic. Each consumer device is coming with its own PSU, which makes transportation difficult and reduces the mobility of the devices.

A universal PSU should be able to adapt its output characteristics to varied load devices requirements. Many today's PSU are already capable of such adaptation and their flexibility will increase in the future. However, the information regarding the load device characteristics have to be communicated to the PSU. Minimum human intervention should be involved in order to facilitate the characteristic selection.

Usually a minimum two wire electrical connection is used for power transfer between PSU and load device (two-wire power cable) and this is the cheapest way of power transfer. Hence a third wire ore more wires are necessary to establish the information transfer by electrical connection means. Prior art describes varies ways of communication by dedicated electrical connection. The information can be transferred in analog format, digital format or combinations of the two.

Other prior art solutions are achieving PSU characteristic selection by means of an electric switch incorporated into the PSU, human intervention being required to place the switch in the desired position. The electrical switches used vary from the simplest (On/Off type) to more complex solutions where two ore more combinations are possible.

Universal PSU are in many cases designed with detachable output cables in order to increase portability. An output socket is integrated into PSU while the output cable is built with a matching jack. A variety of socket-jack systems are available today.

SUMMARY OF THE PRESENT INVENTION

The object of the present patent is the method and apparatus of characteristic selection for a PSU by means of electrical switch integration into the socket-jack system (referred to herein as a Smart Jack). The PSU can be any of the known types: DC-DC, AC-DC, AC-AC and DC-AC.

In its basic form the present invention provides a cable plug configured for a socket-jack system that connects a PSU to a load device over a 2 wire cable. The cable plug is selectively moveable to one of a plurality of positions for selecting a predetermined output voltage (or other operational characteristic) for the load device.

Preferably, a socket is configured to mate with the cable plug, and the cable plug is configured for connection with the socket and is selectively moveable to one of a plurality of positions relative to the socket to provide the selected output voltage (or other operational characteristic) for the load device. The socket and cable plug are configured to lock the socket and cable plug in any of a plurality of the selected positions relative to each other, to establish a selected voltage level at each of the selected positions. The socket and cable plug are preferably rotatable relative to each other to a selected position relative to each other, and are configured to lock with each other in a selected position.

The detailed description below demonstrates a pair of exemplary embodiments for implementing the principles of the present invention. In each embodiment, the socket has a plurality of signal pins, that enable circuit connection to be completed with a selected voltage terminal on the socket when the cable plug and socket are in a selected position relative to each other, to establish circuit connection through the signal pins and selected voltage terminal.

In one of the exemplary embodiments, the cable plug comprises a locator drum, a locator tube disposed within the locator drum. The locator tube is selectively engaged with the locator drum so as to be moveable with the locator drum and is selectively disengaged with the locator drum so as to be moveable relative to the locator tube. A locking mechanism can be selectively engaged with and disengaged from the locator drum, and a pin assembly is located partially inside the locking mechanism and partly inside the locator tube and locator drum. The pin assembly is oriented to establish a circuit connection with selected mating connector(s) (signal pins) of the socket when the cable plug is in a selected position relative to the socket. Positive and ground circuit connection are maintained, irrespective of the relative position of the socket and cable plug, and the pin assembly is configured, so that relative movement of the cable plug relative to the socket enables selection of the selector pin(s) of the socket that will complete a circuit, while the other selector pins are isolated from the circuit.

In the other exemplary embodiment, the selector pin assembly is also connected with the socket and comprises a plurality of signal pins at predetermined locations relative to a positive terminal pin and a negative terminal of the plug. Each signal pin has a selected position in which it can establish circuit connection with a mating signal pin of a socket, and the cable plug has an insulator extending about the positive terminal pin to an extent related to the number of signal pins and their predetermined locations relative to the positive terminal pin, such that when the cable plug is in a selected position relative to the socket, a selected signal pin will establish a circuit connection with a selected voltage terminal, via the positive and negative terminals of the socket, and the insulator will prevent circuit connection between the remaining signal pins and positive and negative terminals of the plug.

Other features of the present invention will become apparent from the following detailed description and the accompanying drawings

DETAILED DESCRIPTION

As set forth above, the present invention provides a cable plug configured for a socket-jack system that connects a PSU to a load device over a 2 wire cable. The cable plug is selectively moveable to one of a plurality of positions for selecting a predetermined output voltage (or other operational characteristic) for the load device.

The present invention is described herein in connection with 2 exemplary embodiments, one of which is shown in FIGS. 3-9, and the other of which is shown in FIGS. 10-15. From that description, the manner in which the principles of the present invention can be practiced with various socket-cable plug configurations will be apparent to those in the art.

Figure 1:
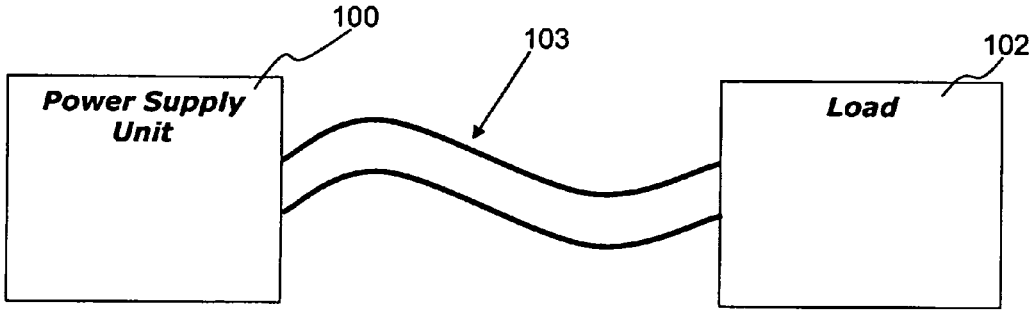
FIG. 1 is a schematic illustration of a classical connection between a PSU and load devices using two-wire power cable.

Initially, FIG. 1 shows a classical connection between a PSU 100 and a load device 102 using a two-wire power cable 103. For simplicity of this presentation, the PSU 100 shown in FIG. 1 has DC output voltage and the load device (or devices) 102 are operating with DC input power.

In each of the disclosed embodiments, the socket is referenced generally by "S" and the cable plug (sometimes referred to as a "power connector plug", "plug assembly" or just a "plug") is referenced generally by "P".

Electrical Concept

The electrical function performed by the cable plug and socket of the present invention is presented in FIGS. 2*a-e*, in simplified form; for example a four positions switch is shown, with the common end connected to electrical ground (GND). The power transfer is performed through power pin contacts between the socket and the cable plug, in a manner that is very familiar to those in the art.

Figure 2:
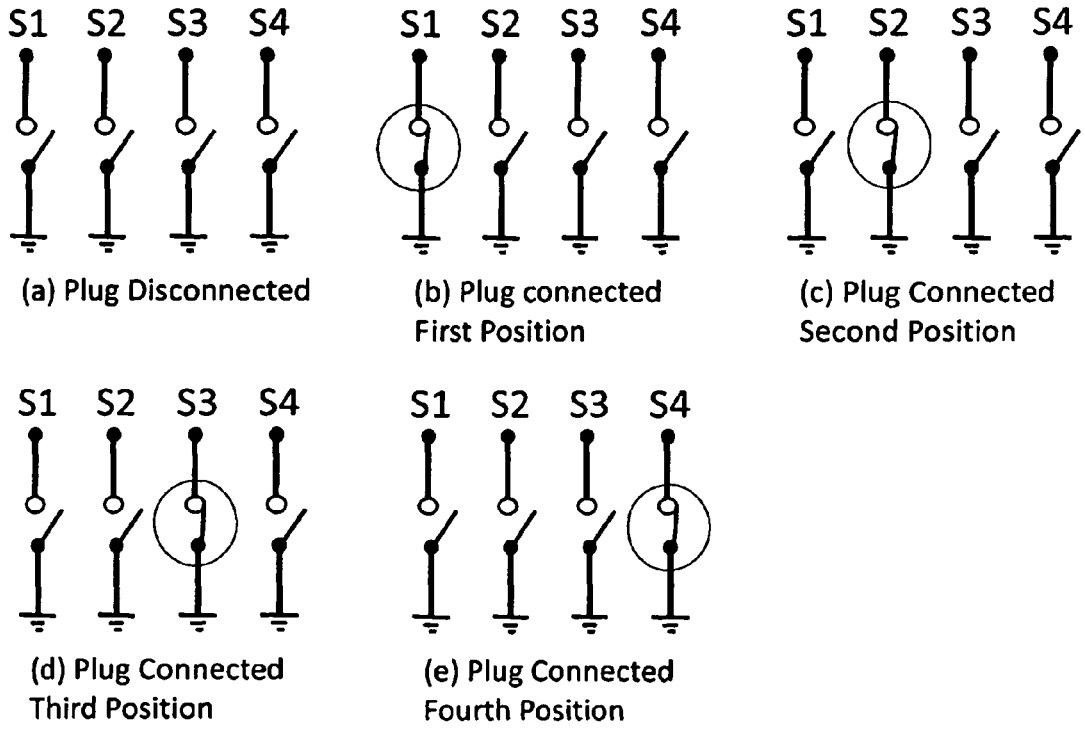
FIGS. 2*a-e* provide a schematic illustration of the electrical function performed by the socket/plug system of the present invention, in simplified form.

All four contacts are open when the cable jack is not plugged (FIG. 2(*a*)), while one of the four contacts is closed when the jack cable is plugged in the corresponding position (FIGS. 2(*b-e*)). Other embodiments of the socket-cable plug function may achieve the closing of two ore more contacts at the time. The S1-S4 connections are electrical signals that are used by the PSU to select a predetermined output voltage (or other characteristic for a given load device). For example, S1 contact closed is selecting a PSU output voltage of 10.5V, S2 contact closed is selecting a PSU output voltage of 12V, S3 contact closed is selecting a PSU output voltage of 15.8V, and S4 contact closed is selecting a PSU output voltage of 19.5V.

First Embodiment of the Socket-cable Plug System (FIGS. 3-9)

Figure 3:
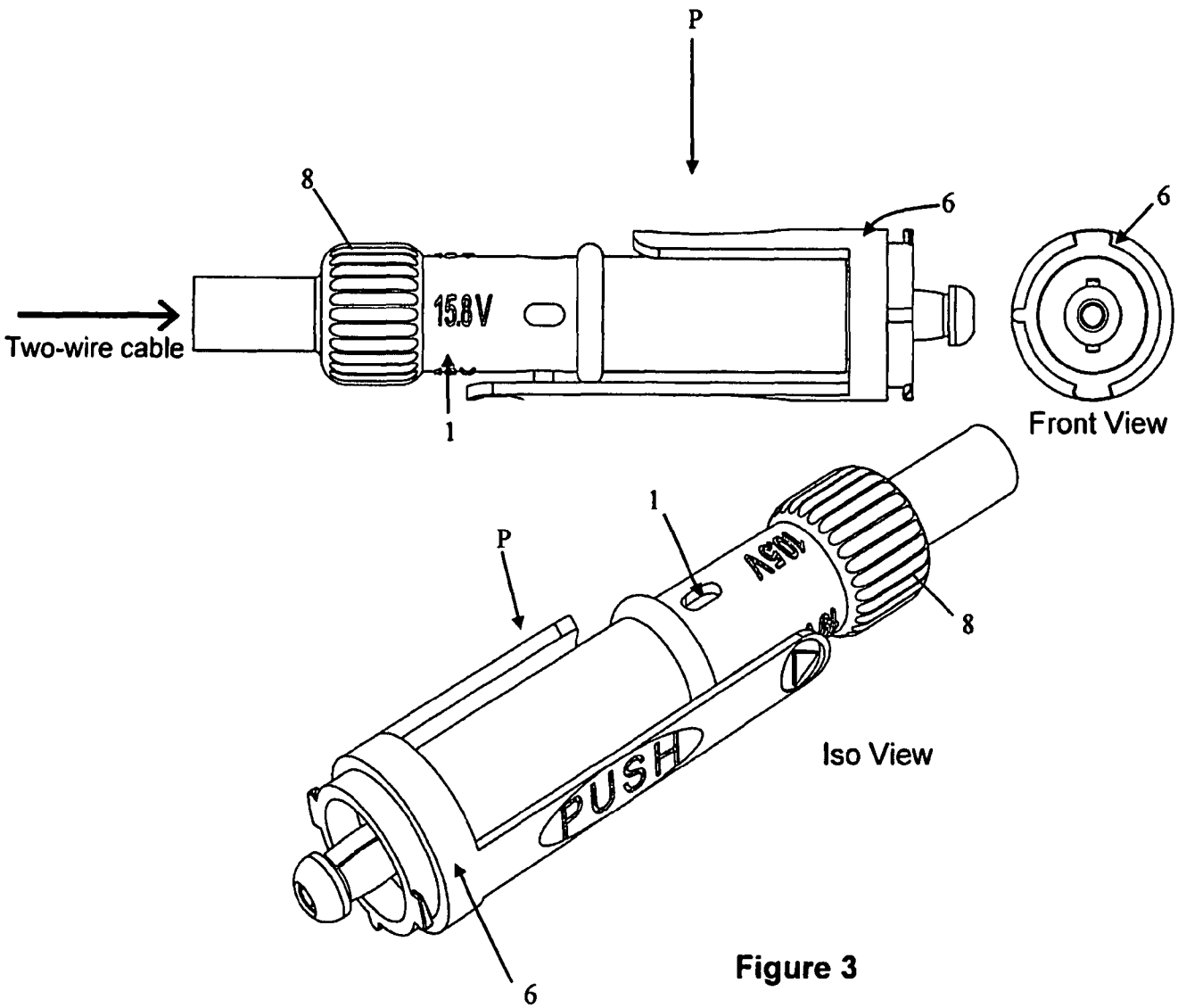
FIG. 3 schematically illustrates views (isometric, side and front views) of the cable plug for a first embodiment of the socket/plug system of the present invention, using as an example four selector positions (following the electrical function described in 2.)

FIG. 3 presents a general view of the cable plug P for a first embodiment of the socket-cable plug system, providing in this example four selector positions (following the electrical function described in 2.).

Figure 4:
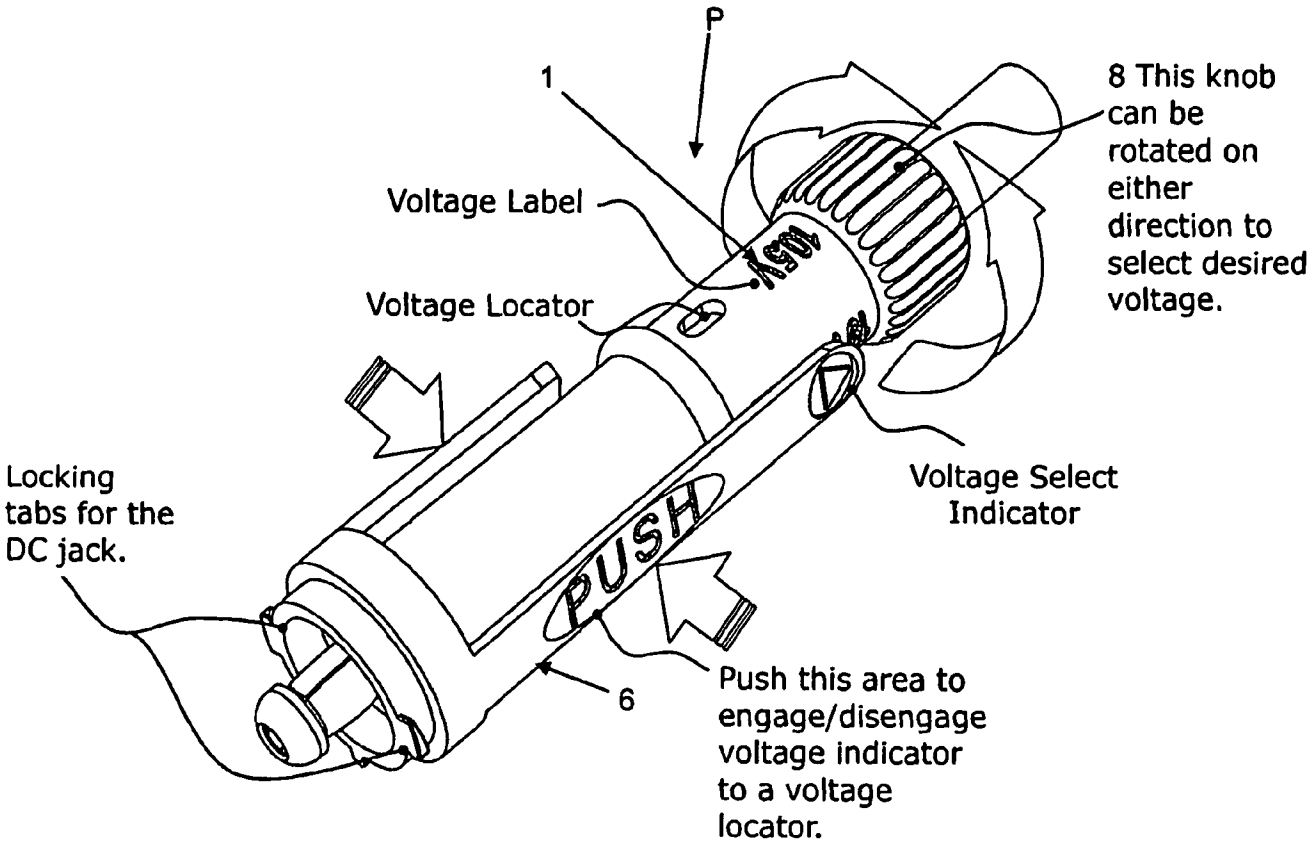
FIG. 4 schematically illustrates, in isometric form, the cable plug for the first embodiment, according to the principles of the present invention.

FIG. 4 presents the same cable plug P with details regarding the selection of one of the four positions by rotating locator drum 1 against locking mechanism 6. Locator drum 1 features locking tabs that will be further locked into the receiving part of the socket S. Therefore rotating locking mechanism 6 in respect of locator drum 1 is equivalent with rotating locking mechanism 6 in respect of the receiving socket S. Locator drum 1 is constructed with a locking system against locking mechanism 6. The rotation between locator drum 1 and locking mechanism 6 is possible only when the locking system is disengaged by pushing it (pressed by finger). Hence a position between locator drum 1 and locking mechanism 6 can be changed only by human action; which means simultaneously pressing the locking system and rotating locator drum 1 against locking mechanism 6.

Figure 5:
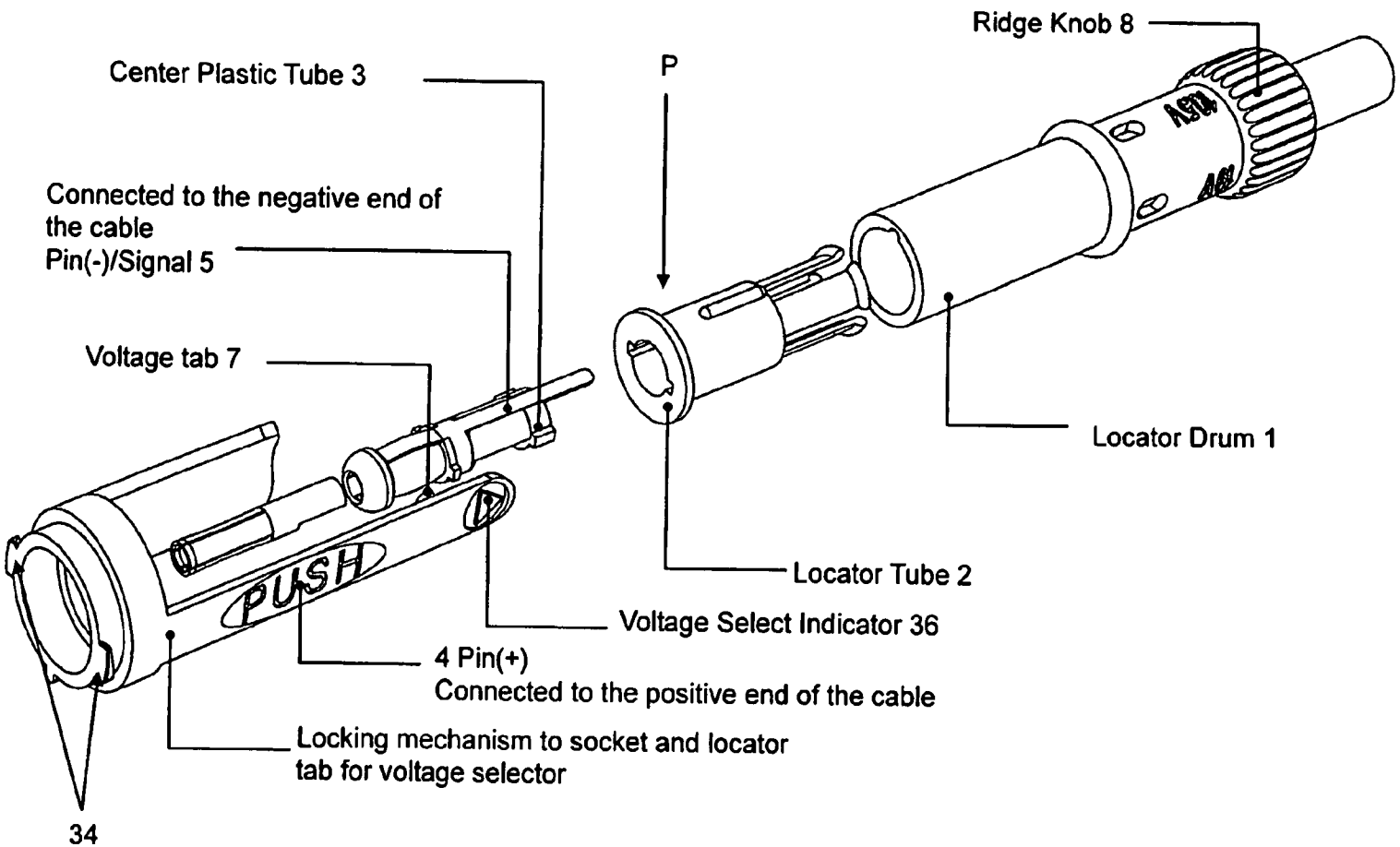
FIG. 5 is an exploded isometric view of the components of the cable plug for the first embodiment.

FIG. 5 shows the detailed construction of the plug assembly P, with locking mechansim 2 disassembled into component parts. The positive end connected terminal is indifferent to the locator drum 1—locking mechanism 6 position, while the negative end connected terminal is sensitive to the locator drum 1—locking mechanism 6 relative position.

Figure 6:
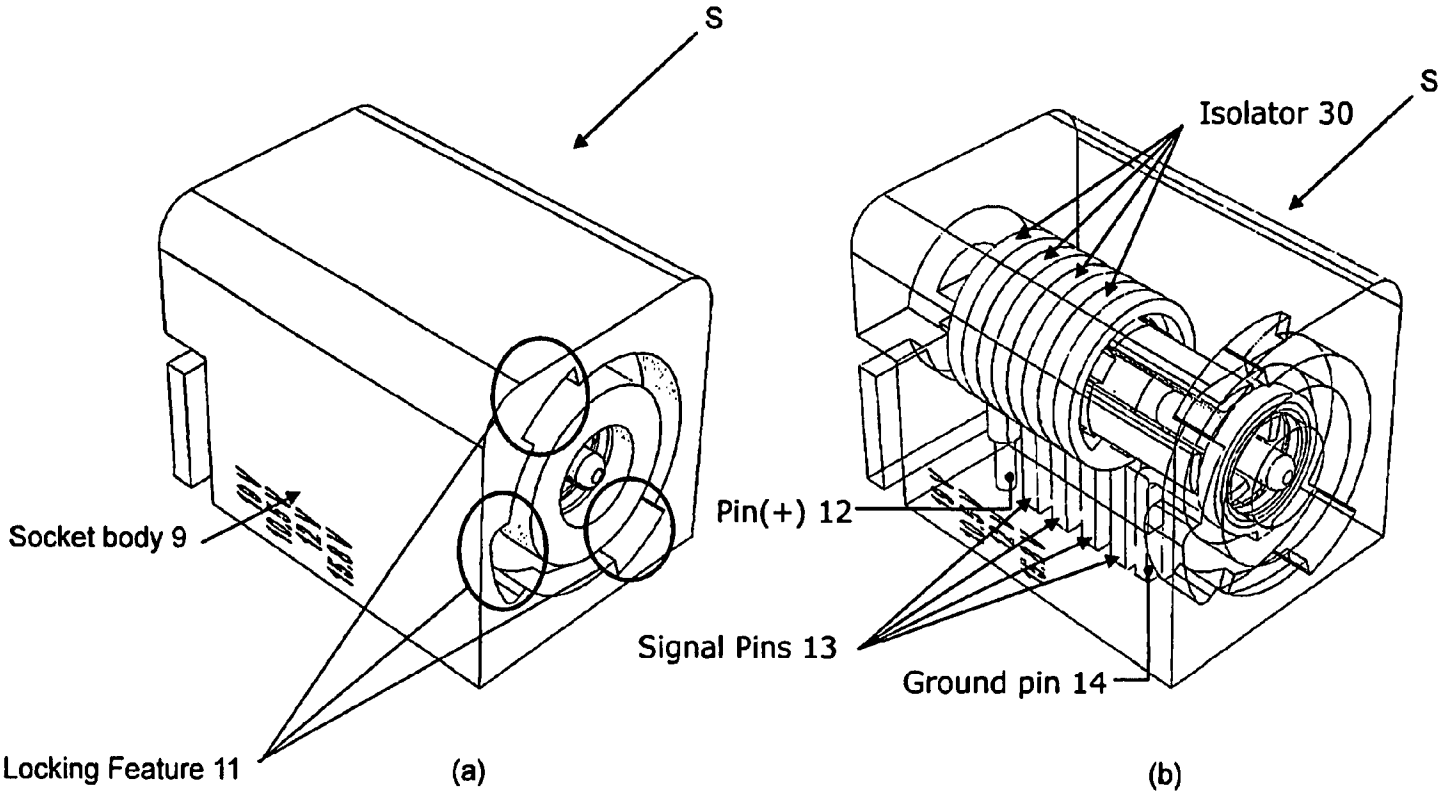
FIGS. 6*a* and 6*b* are schematic views of the socket for the first embodiment of the socket/plug system of the present invention.

The matching socket S for the described plug of the first embodiment is shown in FIG. 6, showing an exterior view and also internal portions that are useful for this description. The socket body 9 features locking grooves 11 (also referred to as locking features) to match the locking tabs 34 of locking mechanism 6. Once the plug P is connected to the socket S, no rotation is possible between locator drum 1 and socket body 9.

Pin (+) 4 is paired with the positive end terminal of the two wire cable, while pin (−) 5 is always connected to the negative end (ground) terminal of the plug. The contact between pin 5 and the negative end terminal of the plug is indifferent to the position of locking mechanism 6 against locator drum 1 and socket body 9 (locator drum and socket body are locket together when the plug P is connected to the socket S).

The four signal pins 13 of the socket S are insolated between them and to the pin (+) 12 and ground (−) pin 14 by the isolator rings 30. Each of the signal pins 13 can connect with the negative end terminal 5 of the plug only when its respective position is selected through the locator tube 1 and locking mechanism 6 assembly.

Figure 7:
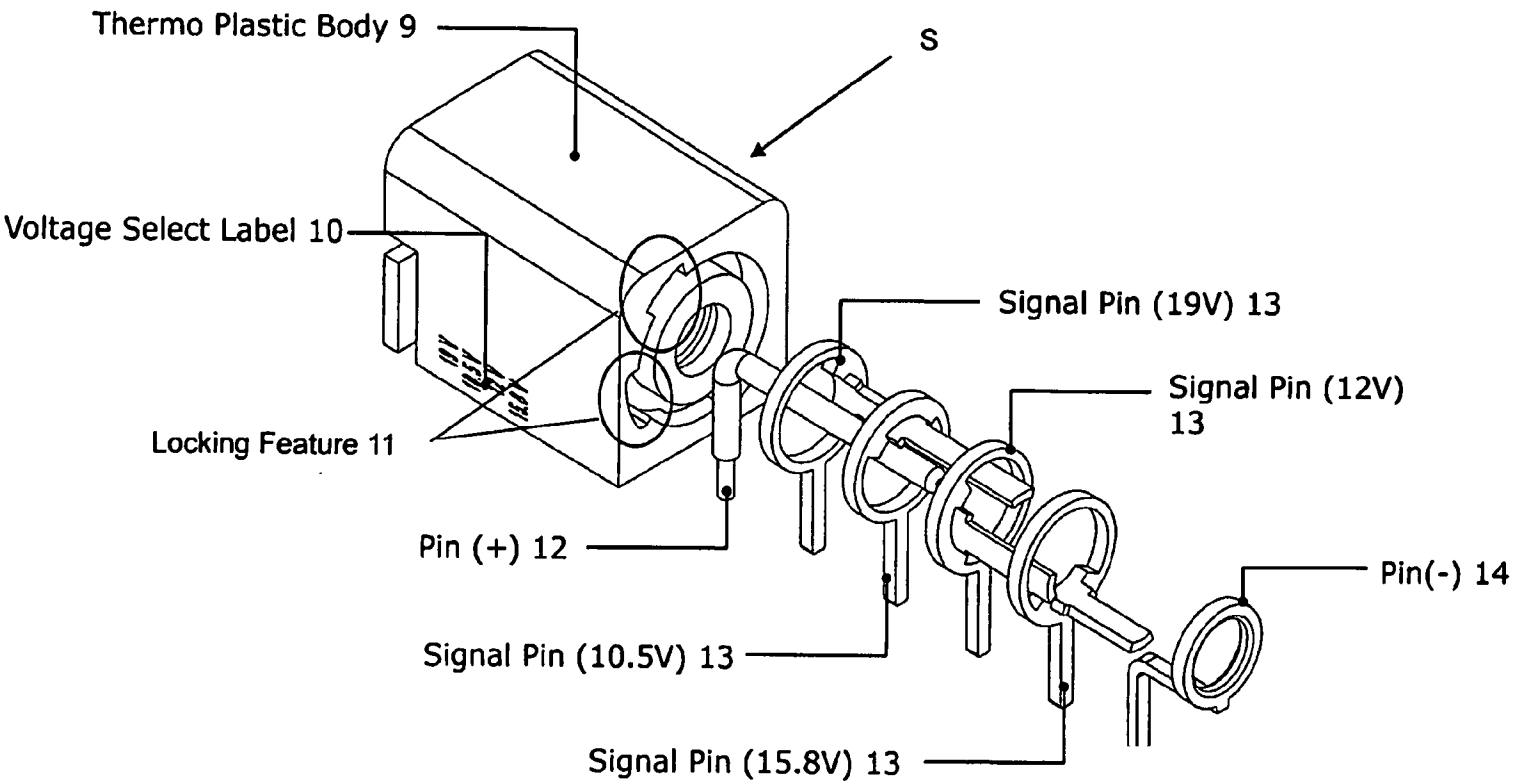
FIG. 7 is a schematic, isometric view of the pin assembly (located in the socket and the plug) for the first embodiment of the socket/plug system of the present invention.
Figure 8:
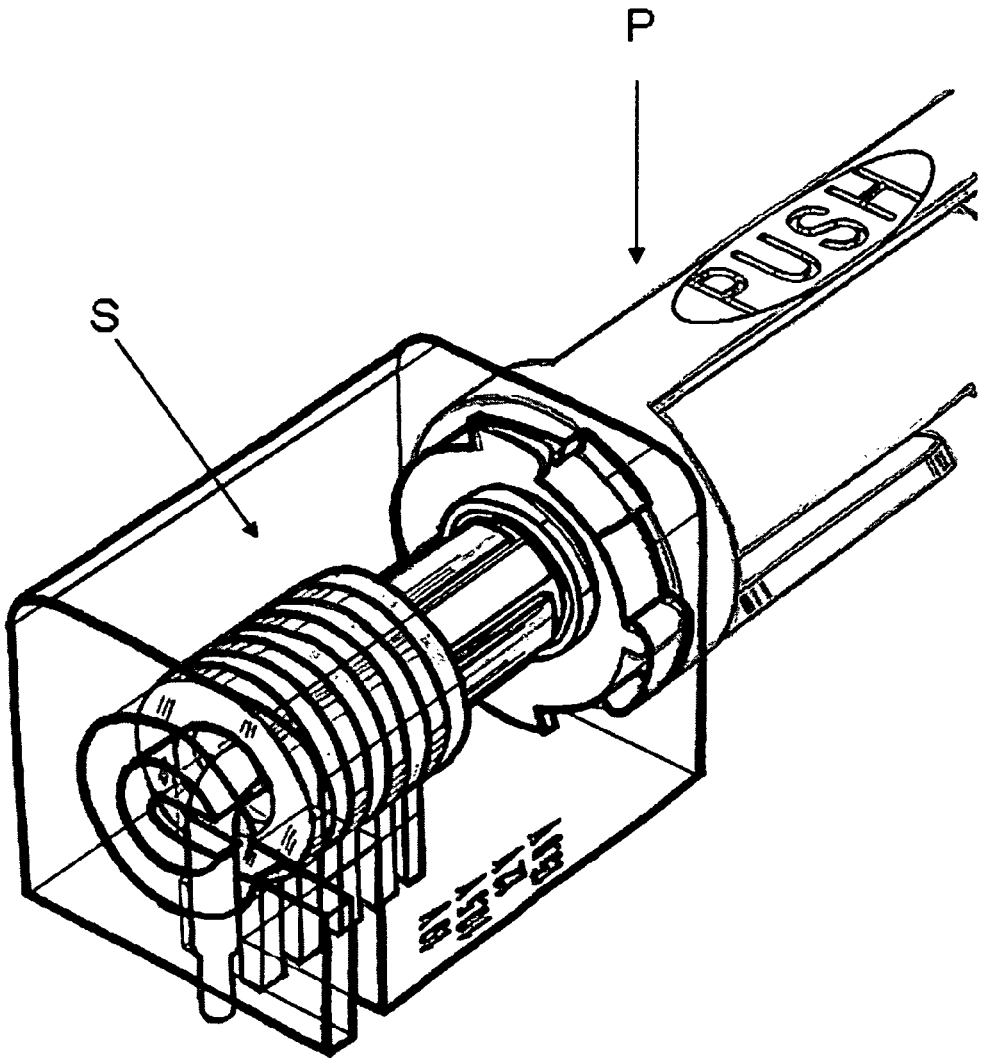
FIG. 8 is a schematic illustration of a connected socket/plug system, according to the principles of the present invention.
Figure 9:
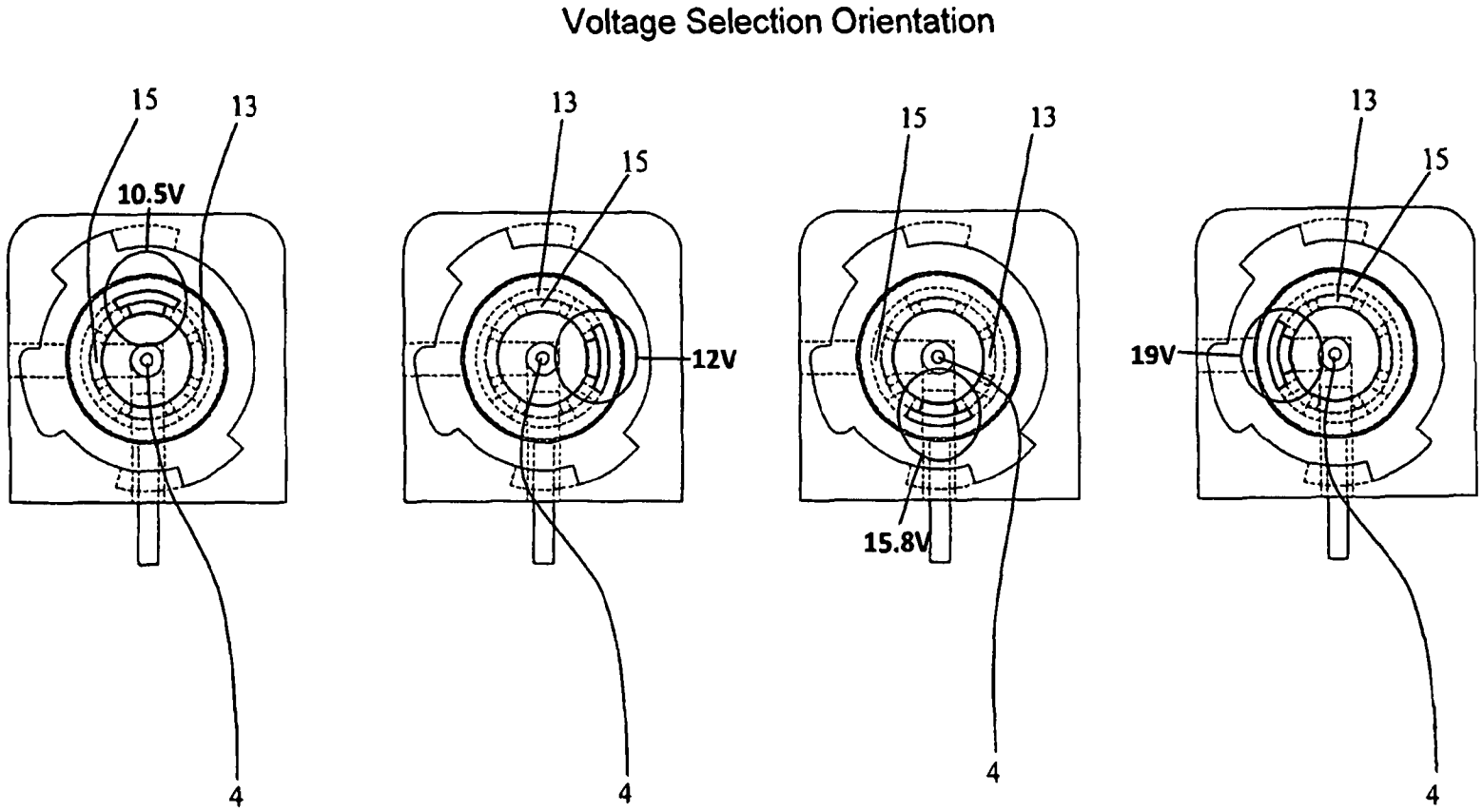
FIG. 9 is a schematic illustration of the manner in which a plurality of positions can be selected for the socket/plug system of the embodiment of FIGS. 3-8, according to the principles of the present invention.

FIG. 7 presents an expanded construction of the pins 12, 13, and 14, and FIG. 8 presents a view of the socket-plug concept of this first embodiment, with the plug P connected to the socket S. FIG. 9 presents the general method of obtaining four positions selector using the contact pins 4, 5 and 13 described herein by contacting one pin at a time or two pins at a time.

In the first embodiment, the power plug P preferably comprises a rotatable locator drum 1 (e.g. an insulating body), a locator tube 2, an insulated center plastic tube 3 separating a conductive terminal "Pin (+)" 4 and a ground terminal "Pin (–)" 5, and a rotatable locking mechanism 6 with a voltage select indicator 36 to indicate voltage placement. A set of electrically conductive terminal and a ground terminal are formed by the insulating center plastic tube 3 having a pair of two insulated wires connected correspondingly to the conductive (+) terminal 4 and the signal/ground (–) terminal 5, thereby forming a center body. The terminal pin 4 is located inside the center plastic tube, and the terminal signal pin 5 is located on the outside of this plastic tube body 3.

Thus, the entire center body is covered by the locator tube 2, the rotatable body (locator drum 1 encloses the center body; and comprises a ridged knob 8 that can be turned to a desired position (while pressing the locking mechanism 6 to lift the voltage tab 7, indicating the voltage selected for the device. This selection feature is accomplished by the locator tube 2 which turns the center insulated body fixing the location of the ground terminal 5 corresponding to the voltage selected via the locator drum 1. The voltage selection is completed by the locking mechanism 6 which serves as a locking system for the assembly and the voltage select indicator 36 for the power plug assembly.

The socket S preferably comprises a thermo plastic body 9 with locking feature 11, and six conductive terminals; a center terminal pin 12 for the positive wire, four (4) ring terminals 13 for the signal pins and a ground ring terminal 14. The thermo plastic body 9 is arranged such that the center section of the thermo body 9 is insulating the positive wire terminal pin 12 while four (4) signal ring terminal 13 and a ground ring terminal 14 are arranged alternately separated by plastic ring around the insulated center section of the thermo body 9. The arrangement of the four (4) signal pin terminals 13 corresponds to the voltage selected for the device, the whole socket assembly has six (6) protruding holes for each terminal to be soldered to a printed circuit board (PCB). The locking feature 11 tabs along the face of the socket fixes the location of the power plug P and the selected voltage intended for the device.

In addition, the following features of the first embodiment should be noted.

a. The power connector plug P includes a hole in the center insulated body encasing the positive pin terminal 4 that is soldered thru the positive end of the (two-wire) power cable.

b. The power connector plug P has, around this center encased terminal, an exposed strip of the ground terminal slightly embedded to part of the center insulated body and is soldered thru the ground end of the (two-wire) power cable.

c. The power connector plug P is configured so that the whole center insulated body is rotated correspondingly to a position indicated by the rotatable locator drum 1 via the locator tube 2, by aligning the ground pin terminal portion to the corresponding position, where the ring signal terminal pin indicates the voltage for the intended device.

d. The power connector plug is fixed in position by a locking mechanism piece when pushed on a opposing side will lift the end piece of the locking mechanism. The locking mechanism comprises a tab that locates to a corresponding slot in the rotatable locator drum indicating the intended voltage of the device.

e. The power connector plug and socket connected in the following manner:

i. The center positive pin terminal 4 of the plug is aligned accordingly to the center pin terminal of the socket.

ii. Moreover, the orientation of the ground pin terminal 14, when inserted will pull the selected signal ring terminal (indicating corresponding voltage) and ground ring terminal to ground.

iii. Finally the plug P is locked in placed by a combination of locking profile 11 located on the face of the socket, and the locking tabs 34 along one side of the plug.

iv. FIG. 9 schematically shows the voltage orientation cross section of the power connector plug and socket assembly.

Second Embodiment of the Socket-cable Plug System (FIGS. 10-15)

Figure 10:
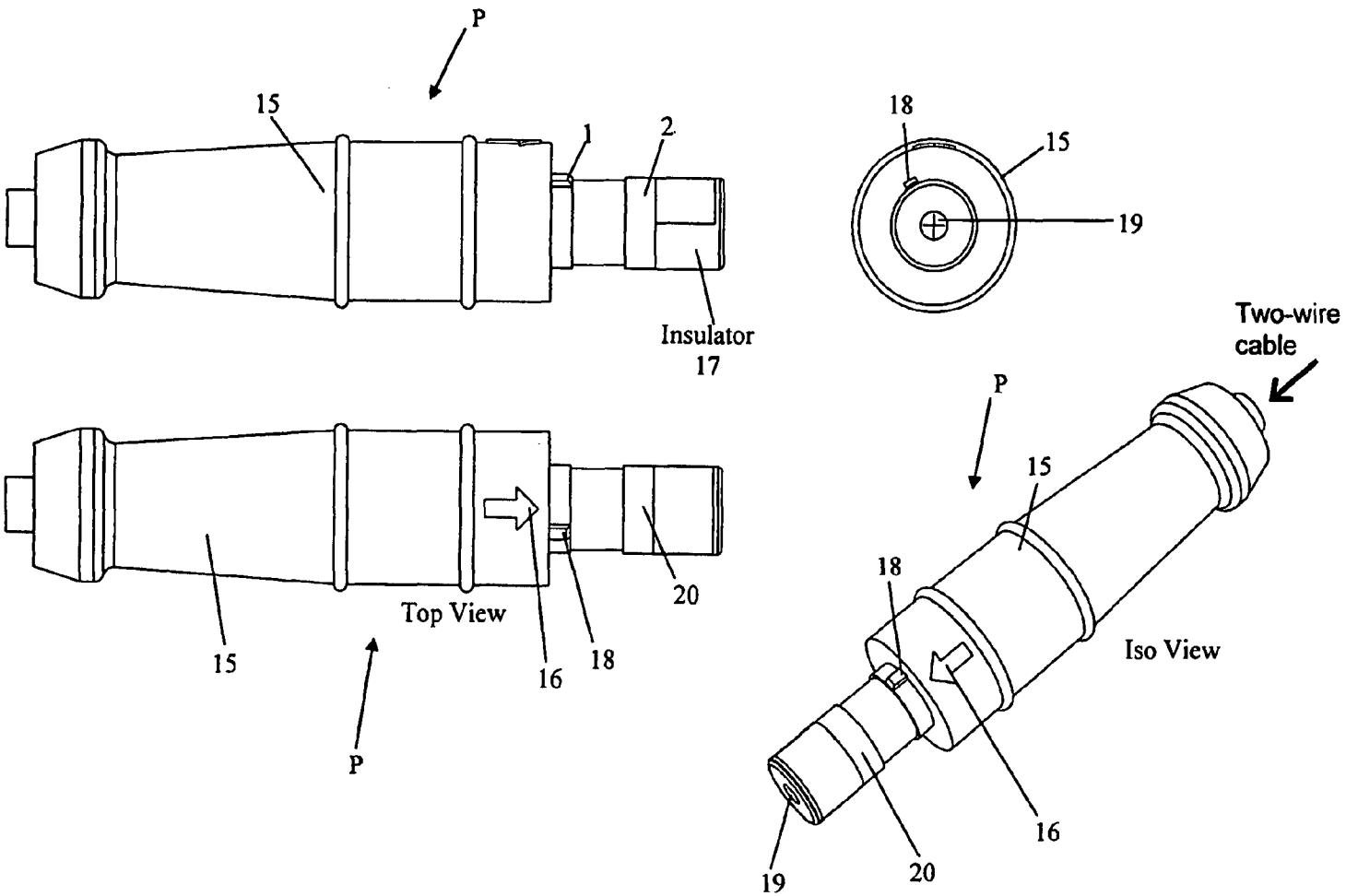
FIG. 10 shows several views of a socket/plug system, according to a second embodiment of the present invention.
Figure 15:
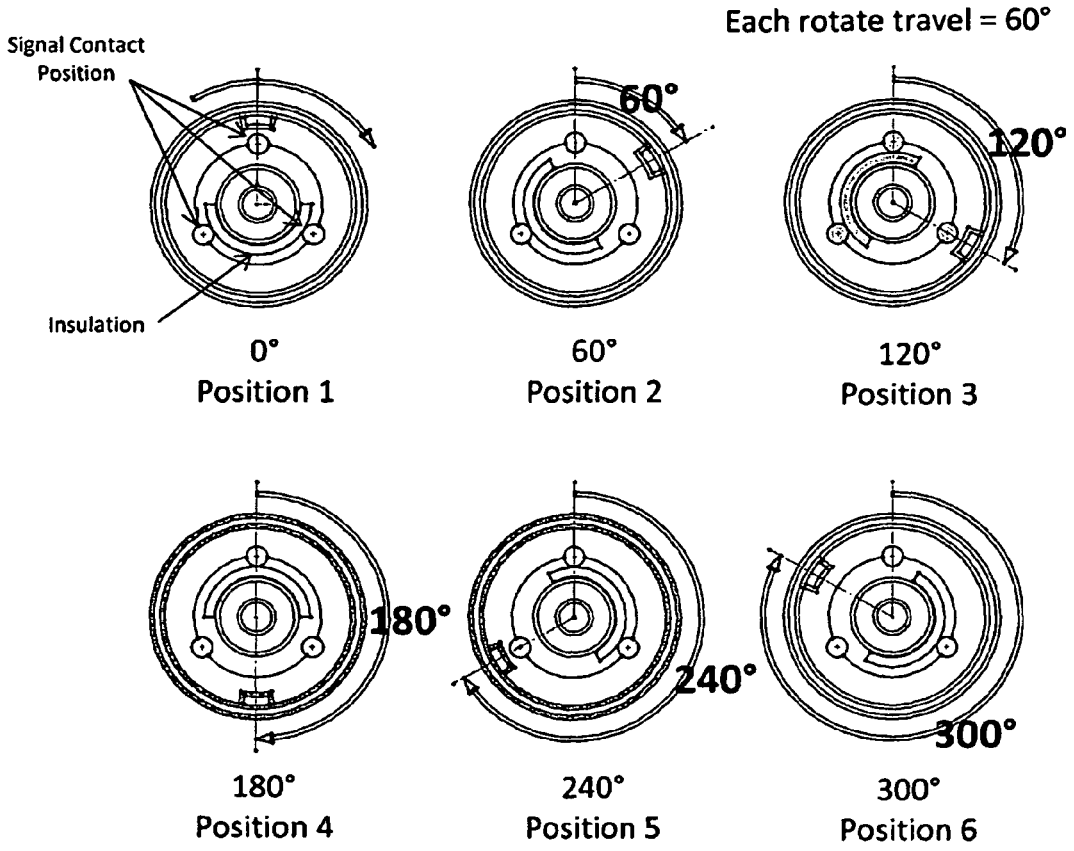
FIG. 15 is a schematic illustration of the manner in which a plurality of positions can be selected for the socket/plug system of the embodiment of FIGS. 10-14, according to the principles of the present invention.

FIG. 10 shows the general view of the plug P of the second embodiment, which achieves the selection by having 180° of the negative end terminal of the plug P covered with insulation 17 in the area of contact with the signal pins of the socket. The three signal pins 27 of the pin assembly are placed inside of the socket body 22 at 120° from each other; therefore the non-insulated part of the negative end terminal of the plug P can touch one or two signal pins at a time, as presented in FIG. 15. FIG. 15 presents the general method of obtaining six positions selector using three contact pins 27—the six combinations are obtained by contacting one pin at a time or two pins at a time.

Figure 11:
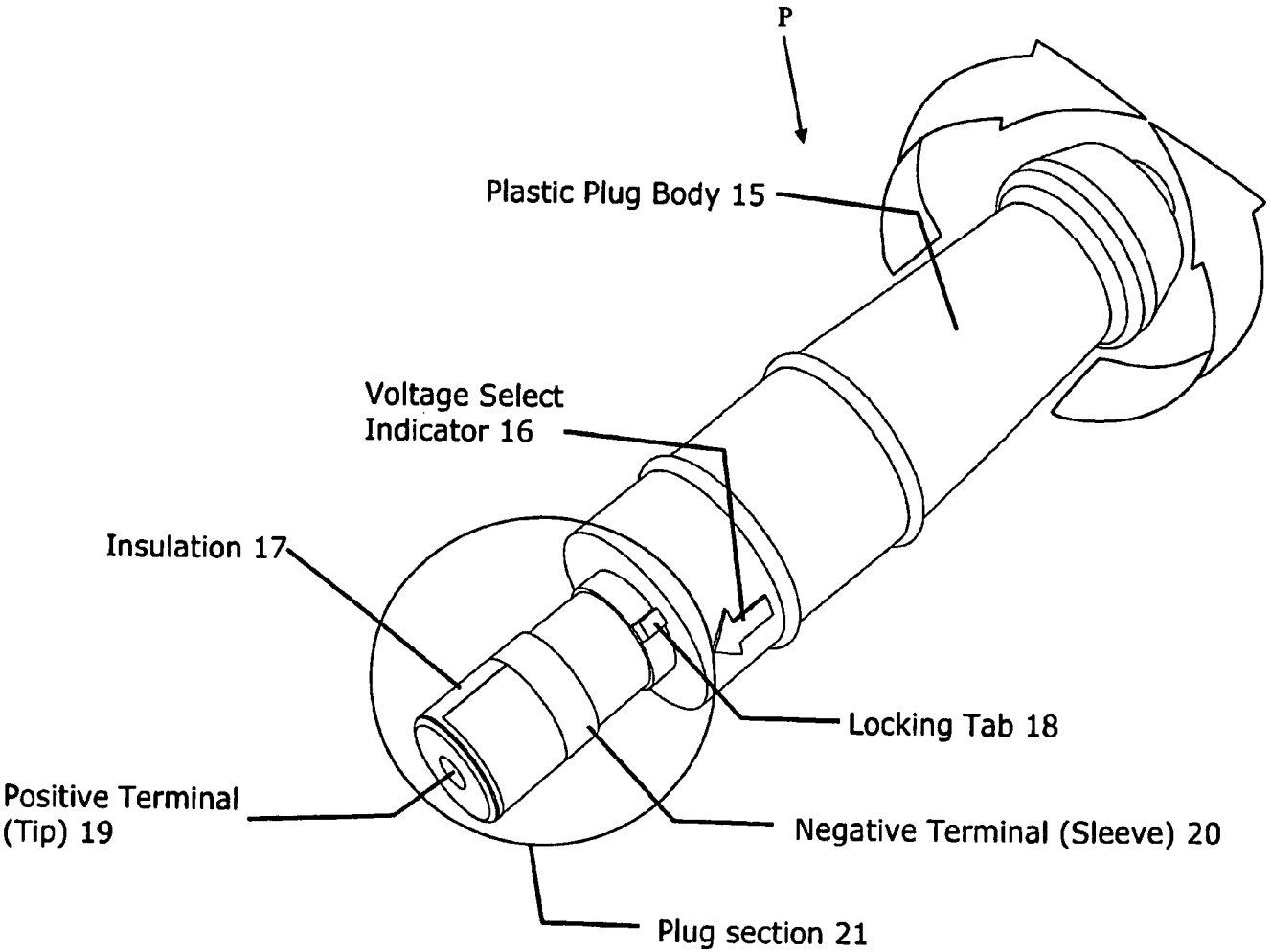
FIG. 11 is an isometric illustration of a cable plug for the second embodiment of the present invention.

FIG. 11 shows the plug P of the second embodiment with details of the negative and terminal, positive end terminal and the 180° isolated area around the end of the negative terminal. The construction of the plug P for the second embodiment includes the 180° isolation area 17 and locking tab 16. This isolation area 17 contributes to the realization of the six positions selector when the plug is inserted into the socket S.

Figure 12:
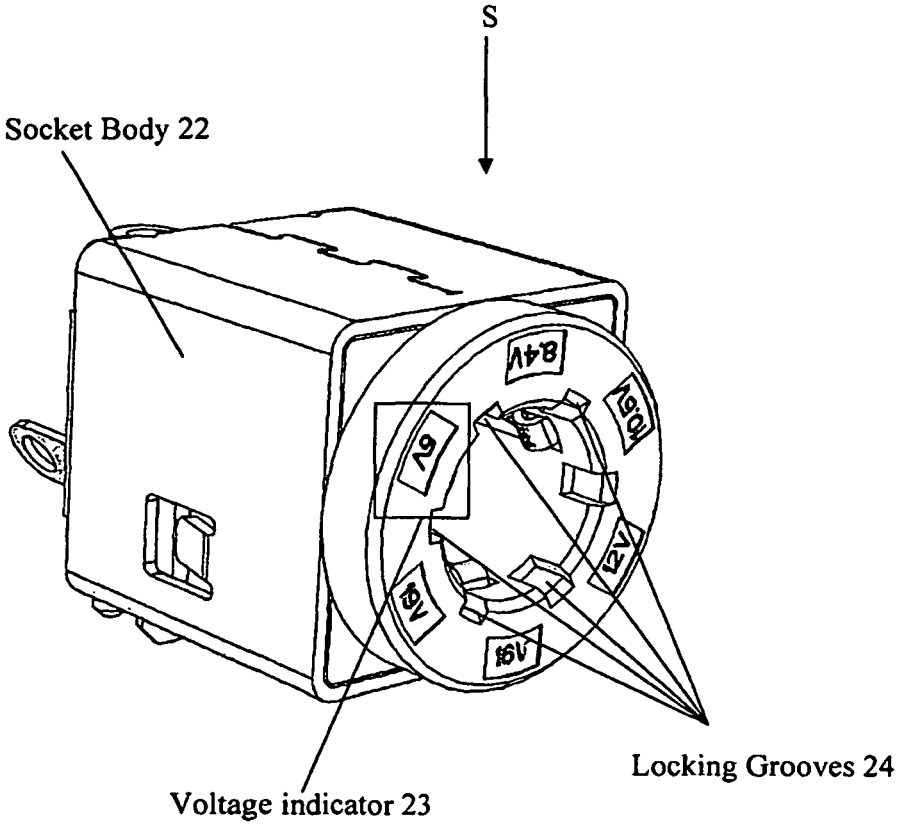
FIG. 12 schematically illustrates a socket for the second embodiment of a socket/plug system, according to the principles of the present invention.
Figure 13:
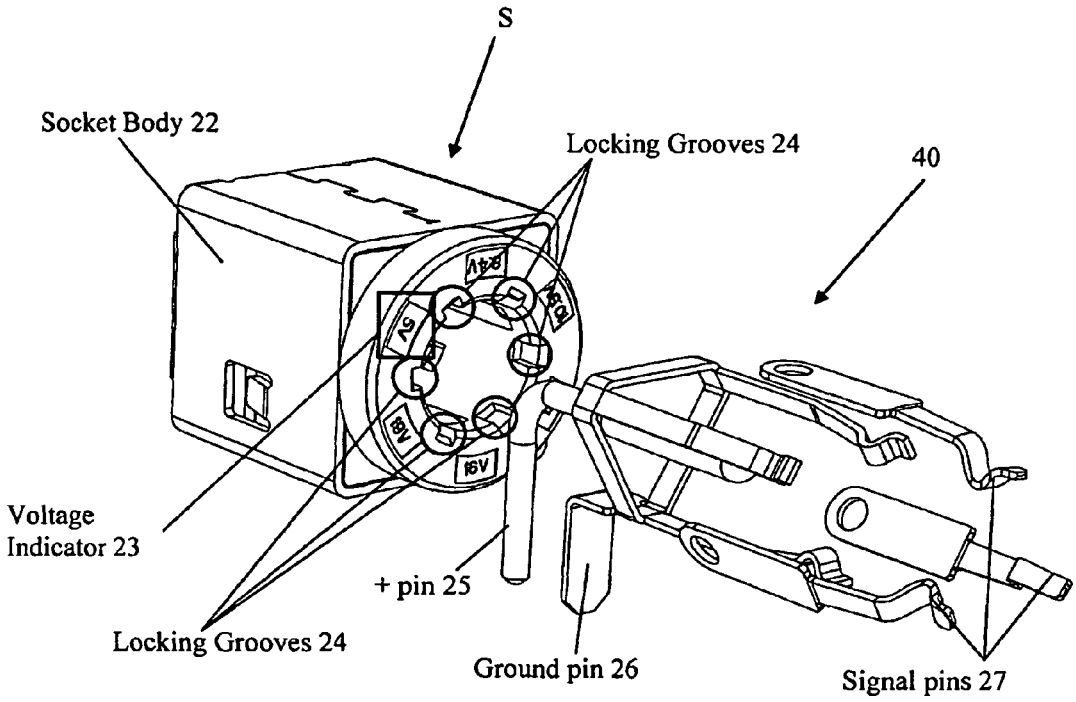
FIG. 13 is a schematic, exploded view of the socket and selector pin assembly, for a socket/plug system according to the second embodiment.

The locking tab 18 of the plug is design to fit in one of the six locking grooves 24 of the socket body 22 (see FIGS. 12, 13). In this second embodiment, six positions can be selected (for example 5V, 8.4V, 10.5V, 12V, 16V and 19.5V). There is a ground pin for power transfer, which contacts the negative end terminal of the plug P at all times, indifferent of the socket-plug locking position. One positive pin is placed in the center of the socket in order to contact the positive end terminal pin 25 of the plug. The three signal pins 27 are place at 120° one from each other and they perform the electrical selection described in FIG. 15 when the plug P is connected to the socket S. The contact between the signal pins and the negative end terminal of the plug is closing the electrical signal circuits described in FIG. 2.

Figure 14:
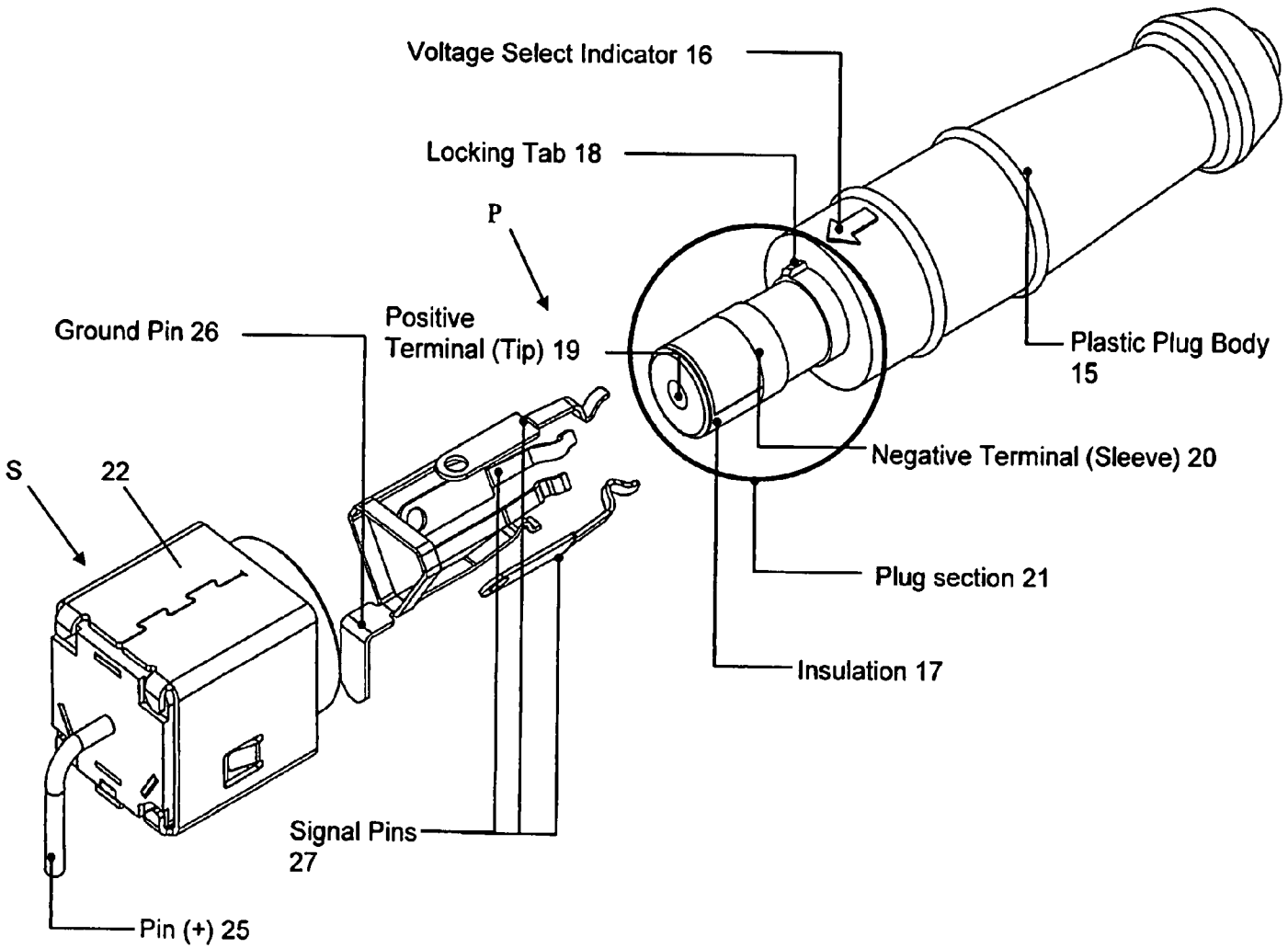
FIG. 14 is a schematic exploded view of a socket/plug, according to the second embodiment.

FIG. 13 an exploded view of the socket S and the pin assembly (including the positive end pin 25, ground pin 26 and signal pins 27. FIG. 14 shows the full socket S-plug P assembly in exploded view.

In the second embodiment, the power connector plug P comprises a plastic plug body 15, voltage select indicator 16, locking tab 18, negative terminal 20, insulated center positive terminal 19, and a partly insulated section 17 of the plug. The signal pin assembly 40 comprises a plurality of electrically conductive signal pins 27, a positive terminal pin 25 and a ground terminal 26. The insulated plug body 15 is arranged such that a pair of two insulated wires are connected correspondingly to the positive terminal 19 and the negative terminal 20. The plug P comprises a conductive cylindrical negative terminal 20 with an insulated center conductive pin (positive terminal 19). Part of the negative terminal 20 is insulated to isolate contact points correspondingly to the signal pin terminals of the socket. The entire plug section and terminal are covered by the plastic plug body 15, and the plug P when inserted to the mating socket S only makes contact to the exposed part of the negative terminal 20 and positive terminal 19, which corresponds to a certain voltage selected for the intended device. The voltage selection is completed by the locking tab 18 which corresponds to a locking groove in the socket assembly and voltage select indicator 16 for the plug.

In the second embodiment, the socket S comprises a socket body 22, six voltage select indicators 23, and locking grooves 24. The pin assembly 40 of the plug P comprises ground pin(s) 26, center positive terminal pin 25 and a signal pin terminals 27. An electrically conductive terminal and ground terminals on the socket are soldered to the PCB such that a one pad hole is for the positive "Pin (+)" 25, and the other pad hole is for the ground terminal 26. On the other end of the ground terminal, the pin assembly is an arrangement of three signal pins 27 equally spaced (120°) in a circular pattern along the cylindrical center cavity of the plug. Consequently, three terminal pins "signal pins 27 are arranged equally spaced (120°) circular pattern such that when the plug and socket are connected each signal terminal pin 27 is in between two ground terminals.

In the second embodiment, it should also be noted that a. the socket body 22 is a thermoplastic material with a stainless steel shell wherein two terminals 25 & 26, are soldered to the PCB and the three signal terminals 27 are connected to the PCB via wires soldered to the PCB board.

b. the socket S has a cylindrical cavity wherein the arrangement of alternately spaced terminals of the signal pins 27 and ground pin(s) 26, such that the circular pattern space for each terminal is 60°.

c. The power connector plug and socket are connected in the following manner:

i. the center positive pin terminal 25 is aligned accordingly to the center pin terminal of the socket, and locked in place by a locking groove 24 and the tab 18.

ii. the circular pattern arrangement of the ground pin terminal and signal pin terminal are configured such that, when inserted to one position, say for example position 1 (see FIG. 15) in this orientation one signal pin terminal is connected to ground which corresponds to a certain voltage.

iii. FIG. 15 shows in cross section the orientation of the conductive terminals and insulator of the power connector plug and socket assembly, in the various orientation of the plug and socket.

Thus, as seen from the foregoing detailed description, the present invention provides a cable plug configured for a socket-jack system that connects a PSU to a load device over a 2 wire cable. The cable plug is selectively moveable to one of a plurality of positions for selecting a predetermined output voltage (or other operational characteristic) for the load device.

Preferably, and as shown in each of the exemplary embodiments, a socket is configured to mate with the cable plug, and the cable plug is configured for connection with the socket and is selectively moveable to one of a plurality of positions relative to the socket to provide the selected output voltage (or other operational characteristic) for the load device. The socket and cable plug are configured to lock the socket and cable plug in any of a plurality of the selected positions relative to each other, to establish a selected voltage level at each of the selected positions. The socket and cable plug are preferably rotatable relative to each other to a selected position relative to each other, and are configured to lock with each other in a selected position. Moreover, in each embodiment, the cable plug has a pin assembly with a plurality of pins, with selected pins being connected with connects with a selected connector on the socket when the cable plug and socket are in a selected position relative to each other, to establish circuit connection through the selected pins and connector.

In one of the exemplary embodiments, shown in FIGS. 3-9, the cable plug comprises a locator drum, a locator tube disposed within the locator drum. The locator tube is selectively engaged with the locator drum so as to be moveable with the locator drum and is selectively disengaged with the locator drum so as to be moveable relative to the locator tube. A locking mechanism can be selectively engaged with and disengaged from the locator drum, and a pin assembly is located partially inside the locking mechanism and partly inside the locator tube and locator drum. The pin assembly is oriented to establish a circuit connection with selected a mating connector(s) (signal pins) of the socket when the cable plug is in a selected position relative to the socket. Positive and ground circuit connection are maintained, irrespective of the relative position of the socket and cable plug, and the pin assembly is configured, so that relative movement of the cable plug relative to the socket enables selection of the selector pin(s) of the socket that will complete a circuit, while the other selector pins are isolated from the circuit.

In the other exemplary embodiment, shown in FIGS. 10-15, the pin assembly is located in the socket and comprises a plurality of signal pins at predetermined locations relative to a positive terminal pin and one or more ground pins. Each signal pin has a selected position in which it can establish circuit connection with a mating connector of a socket, and the cable plug has an insulator extending about the positive terminal pin to an extent related to the number of signal pins and their predetermined locations relative to the positive terminal pin, such that when the cable plug is in a selected position relative to the socket, a selected signal pin with establish a circuit connection with a mating connector of the socket, and the insulator will prevent circuit connection between the remaining signal pins and the mating connectors of the socket.

Thus, the foregoing description provides, among other features, a new and useful cable plug and socket system connecting a PSU to a load device over a 2 wire cable. The cable plug is selectively moveable to one of a plurality of positions for selecting a predetermined output voltage (or other operational characteristic) for the load device In addition, a new and useful socket is provided, that is configured to mate with the cable plug, to provide the selected output voltage (or other operational characteristic) for the load device.

The invention claimed is:

1. An apparatus comprising a cable plug and socket configured for a socket-jack system that connects a power supply unit to a load device over a 2 wire cable, the cable plug being selectively moveable to one of a plurality of positions for selecting a predetermined output voltage or other operational characteristic for the load device;

wherein the socket of the socket-jack system; and the cable plug are configured to lock the socket and cable plug in any of a plurality of the selected positions relative to each other, to establish a selected voltage level at each of the selected positions;

wherein the socket has a pin assembly with a plurality of signal pins, selected signal pins being configured to connect with mating connectors of the cable plug when the cable plug and socket are in a selected position relative to each other, to establish circuit connection through the selected pins and mating connectors; and wherein the cable plug comprises a locator drum, a locator tube disposed within the locator drum, the locator tube being selectively engaged with the locator drum so as to be moveable with the locator drum and being selectively disengaged with the locator drum so as to be moveable relative to the locator tube, a locking mechanism that can be selectively engaged with and disengaged from the locator drum, and a pin assembly located partially inside the socket, the pin assembly including a plurality of selector pins, each oriented to establish a circuit connection with a mating connector of the cable plug when the cable plug is in a selected position relative to the socket.

2. The apparatus of claim 1, wherein the cable plug includes a ground connector pin and a positive terminal pin that maintain positive and ground circuit connection with mating connectors of the socket, irrespective of the relative position of the socket and cable plug, the selector pins being spaced along the pin assembly and isolators located between the selector pins, in an orientation such that relative movement of the cable plug relative to the socket enables selection of the selector pins that will be engaged by the positive terminal pin on the cable plug to complete a circuit, and the isolators isolate the other selector pins from the circuit.

3. An apparatus comprising a cable plug and socket configured for a socket-jack system that connects a power supply unit to a load device over a 2 wire cable, the cable plug being selectively moveable to one of a plurality of positions for selecting a predetermined output voltage or other operational characteristic for the load device;

wherein the socket of the socket-jack system and the cable plug are configured to lock the socket and cable plug in any of a plurality of the selected positions relative to each other, to establish a selected voltage level at each of the selected positions;

wherein the socket has a pin assembly with a plurality of signal pins, selected signal pins being configured to connect with mating connectors of the cable plug when the cable plug and socket are in a selected position relative to each other, to establish circuit connection through the selected pins and mating connectors; and wherein the pin assembly comprises a plurality of signal pins at predetermined locations relative to a positive terminal pin and one or more ground pins, each signal pin having a selected position in which it can establish circuit connection with a mating connector of a socket, and wherein the cable plug has an insulator extending about the positive terminal pin to an extent related to the number of signal pins and their predetermined locations relative to the positive terminal pin, such that when the cable plug is in a selected position relative to the socket, a selected signal pin will establish a circuit connection with a mating connector of the socket, and the insulator will prevent circuit connection between the remaining signal pins and the mating connectors of the socket.

4. An apparatus comprising a cable plug and socket configured for a socket-jack system that connects a power supply unit to a load device over a 2 wire cable, the cable plug being selectively moveable to one of a plurality of positions for selecting a predetermined output voltage or other operational characteristic for the load device;

wherein the cable plug comprises a. an insulated locator drum, a locator tube, an insulated center tube separating a conductive terminal and a ground terminal, and a moveable locking mechanism to indicate voltage placement, b. a center body comprising the insulated center tube covering the conductive terminal, and the ground terminal which is located on the outside of the insulated center tube, c. the locator tube connected with the center body and the locator drum in a manner such that movement of the locator drum causes movement of the locator tube and also effects movement of the center body, d. the locator tube having an engaged condition where it is engaged with the locking mechanism and a disengaged condition where it is disengaged from the locking mechanism and can be moved along with the center body and locator drum relative to the locking mechanism, and e. the locking mechanism and locator drum are coupled together in a manner that covers the center body and the locator tube, and are configured to enable relative movement of the locking member and locator drum to selected positions relative to each other while the locator tube is disengaged from the locking mechanism.

5. The apparatus of claim 4, wherein the socket comprises, a body having a locking feature and a plurality of conductive terminals, a center terminal pin for connection with a positive terminal pin of the cable plug, a ground terminal, and a plurality of conductive terminals, each having a signal pin for connection with a conductive terminal of the cable plug, when the center body is in a selected position in the socket, and the conductive terminal being electrically isolated from the remaining signal pins when the center body is in the selected position in the socket.

* * * * *